United States Patent [19]

Kikuchi et al.

[11] Patent Number: 4,950,092

[45] Date of Patent: Aug. 21, 1990

[54] WIRE DOT PRINT HEAD WITH A PAIR OF GUIDE NOSE HALVES

[75] Inventors: Hiroshi Kikuchi; Youichi Umezawa; Hirokazu Andou; Minoru Teshima; Noboru Ohishi; Mitsuru Kishimoto, all of Tokyo, Japan

[73] Assignee: Oki Electric Industry Co., Ltd., Tokyo, Japan

[21] Appl. No.: 269,713

[22] Filed: Nov. 10, 1988

[30] Foreign Application Priority Data

Nov. 10, 1987 [JP] Japan ..... 62-170723[U]
Mar. 23, 1988 [JP] Japan ..... 63-37200[U]

[51] Int. Cl.[5] ..... B41J 3/12
[52] U.S. Cl. ..... 400/124; 101/93.05
[58] Field of Search ..... 400/124; 101/93.05

[56] References Cited

U.S. PATENT DOCUMENTS

| | | | |
|---|---|---|---|
| 3,921,780 | 11/1975 | Gentzlinger | 400/124 X |
| 4,047,606 | 9/1977 | Ott | 400/124 |
| 4,158,909 | 6/1979 | Einem | 400/124 X |
| 4,180,333 | 12/1979 | Linder | 400/124 |
| 4,229,114 | 10/1980 | Van Horne | 400/124 X |
| 4,309,116 | 1/1982 | Maeda | 400/124 |
| 4,572,070 | 2/1986 | Moulin | 400/124 X |
| 4,708,502 | 11/1987 | Murakami | 400/124 X |

FOREIGN PATENT DOCUMENTS

| | | | |
|---|---|---|---|
| 174829 | 3/1986 | European Pat. Off. | 400/124 |
| 2807337 | 8/1978 | Fed. Rep. of Germany | 400/124 |
| 131072 | 8/1983 | Japan | 400/124 |
| 122168 | 6/1985 | Japan | 400/124 |
| 278054 | 12/1987 | Japan | 400/124 |

OTHER PUBLICATIONS

IBM Technical Disclosure Bulletin, vol. 27, No. 4B, Sep. 1984, pp. 2557–2558, N.Y., U.S.; R. G. Cross et al.: "Two-Part Molded Matrix Print Head".

The Transactions of the IECE of Japan, vol. 365, No. 7, Jul. 1982, pp. 397–404, "A Study for the Design of a New Mechanism of Wire Dot Print Head", Watanabe et al.

*Primary Examiner*—David A. Wiecking
*Attorney, Agent, or Firm*—Wenderoth, Lind & Ponack

[57] ABSTRACT

In a wire dot print head having print wires extending through an opening of a guide nose, the guide nose comprises two halves. The print head may further comprise a wire guide which is fitted in the guide nose and through which the print wires extend, and the wire guide may be clamped by the two halves. In another embodiment, the half members have abutting surfaces provided with semi-circular grooves, which when the guide nose halves are assembled, form guide holes in which the print wires are slidably supported. The use of the two halves facilitates assembly of the print head and reduces noise.

14 Claims, 9 Drawing Sheets

WIRE DOT PRINT HEAD WITH A PAIR OF GUIDE NOSE HALVES

BACKGROUND OF THE INVENTION

The present invention relates to a print head of a wire dot printer, and more particularly to a wire dot print head in which a pair of guide nose halves are made to abut to form a guide nose.

An example of a print head used in a wire dot printer is a spring-charged print head shown in FIG. 1 which is a partial cross section. The dot print head 309 has plate springs 393 and armatures 394 between a guide nose 391 and a head printed circuit board 392. Print wires 395 provided at the free ends of the armatures 394 extend through wire guides 396 and project from guide holes 397 provided in the tip guide 391*a* of the guide nose 391.

That is, the print wires 395 are surrounded or enveloped by the guide nose 391, and the wire guides 396 disposed inside the guide nose 391 limit movement of the print wires 395 and restrain vibrations.

A permanent magnet 399 and electromagnets 398 which are provided below the guide nose 391, and yokes 394*a* form magnetic circuits. When the electromagnets 398 are not energized, the armatures 394 are attracted toward the electromagnets 398 due to the magnetic flux from the permanent magnet 399. When the electromagnets 398 are energized, the magnetic flux from the electromagnets cancel the magnetic flux from the permanent magnet and the armatures 394 are released so that the print wires 395 are projected from the guide holes 397 by virtue of the resilient reactive force of the plate springs 393 to press the print wires 395 against an ink ribbon IR and a print paper PP on a platen PL.

When the dot print head 309 of the above structure is assembled, a wire assembly having print wires 395 inserted through the wire guides 396 is assembled from below (as seen in FIG. 1) the guide nose 391 and the tips of the print wires 395 are aligned with the guide holes 397. For this purpose, an air gap AG is needed to permit the wire guide 396 to fit in the guide nose 391.

However, because of the presence of the air gap AG, carbon particles or the like that have entered through the guide holes 397 are accumulated inside the guide nose 391 and cause oxidation of the print wires 395.

Moreover, noise, i.e. contact-slide noise, generated when the print wires 395 slide against the wire guide 396 is loud because the air gap AG functions as an echoing chamber.

Another prior-art print head is shown in a sectional view of FIG. 2. As shown, it comprises plate springs 471 and armatures 472 which are provided between a guide nose 470 and a head printed circuit board 480. The print wires 473 fixed to the free ends of the armatures 472 are made to project from guide holes 474*a* of the tip guide 174.

An intermediate guide 476 and a guide felt 477 provided in the cavity in the guide nose 470 support the print wires 473 and serves to prevent vibration. In a drive part provided below the guide nose 470, a magnetic circuit is formed of electromagnets 478, a permanent magnet 479 and yokes. By virtue of this magnetic circuit, the armatures are attracted, and by virtue of the resilient reactive force of the plate springs 471, the print wires 473 are projected from the guide holes 474*a* to press an ink ribbon IR and a paper PP onto a platen PL. Printing is thereby accomplished.

When the wire dot print head 409 of the above structure is assembled, as shown in the exploded oblique view of FIG. 3, print wires 473 on a wire assembly 481 are assembled from below the guide nose 470 and the tips 473*a* of the print wires 473 are fitted in the guide holes 474*a* of the tip guide 474. Then, a guide felt 477, for preventing vibration of the print wires 473 and the like, is inserted through an insertion opening 490 provided on the side of the guide nose 470 into a cavity 475.

The print wires 473 on the spring assembly 481 are normally thin and not associated with support members so that although they stand by themselves they are easy to vibrate and therefore it is difficult to align them with and insert them in the holes 476*a* of the intermediate guide 476. Moreover, even when they are fitted in the holes 476*a*, the tips 473*a* of the print wires again have to be aligned with the holes 474*a* in the tip guide 474. It is thus laborious to fit the print wires in the guide holes 474*a* and the holes 476*a*. On the other hand, the insertion opening 490 provided at the side of the guide nose 470 is open even after the guide felt 477 is inserted, so that the contact-slide noise and the like of the print wires 173, which is generated when the wire dot print head is driven, leaks out of the insertion opening 490 causing a high noise, level.

SUMMARY OF THE INVENTION

An object of the invention is to solve the above problems.

Another object of the invention is to facilitate assembly of the print head.

Another object of the invention is to provide more secure support of the print wires.

Another object of the invention is to reduce noise emanating from a print head.

According to the present invention, a guide nose comprises two halves. In one aspect of the invention, the wire guide is clamped by the pair of guide nose halves.

When the dot print head is assembled, the wire guide through which the print wires are inserted in advance are clamped from the left and the right by the pair of guide nose halves. The air gap inside the guide nose is therefore not necessary. Moreover, the wire guide itself is clamped by the pair of guide nose halves and so is more securely fixed.

In another aspect of the invention, the guide nose halves each having a tip guide part and side parts forming a semi-annular recess are made to about. The semi-annular recesses of the guide nose halves constitute a sealed cavity within the guide nose. The semi-annular grooves provided on the abutting surfaces of the tip guide parts confronting each other form guide holes through which the print wires extend and by which the print wires are supported. Accordingly, when the print wires of the spring assembly are placed in the grooves of one of the guide nose halves and the other nose half is made to abut, then the print wires are fit in the guide holes. As a result, the insertion of the print wires into the holes is substantially simplified.

Moreover, if a guide felt or the like is mounted in the cavity of the two guide frames, when the guide nose halves are made to abut each other, the guide felt is then already inserted in the cavity. Thus, the guide nose need not have an opening for insertion of the guide felt or the like. Furthermore the contact-slide noise of the print wires or the like will not leak outside.

BRIEF DESCRIPTION OF THE DRAWINGS

FIG. 1o is an oblique view of guide nose half members forming a guide nose according to a second embodiment of the invention.

DETAILED DESCRIPTION OF THE EMBODIMENT

Figure 1:
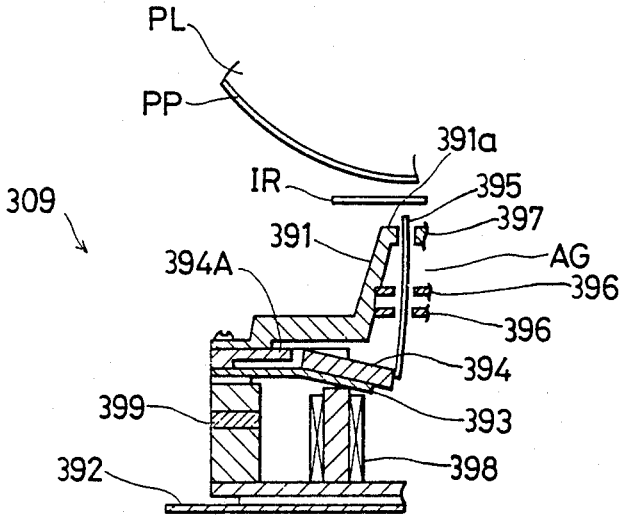
FIG. 1 PRIOR ART
FIG. 1 is a partial sectional view showing a conventional print head.

FIG. 4 through FIG. 12 show an embodiment of the invention. As illustrated, a dot print head 1 of this embodiment comprises a guide nose 20 formed of a pair of guide nose half members 21. As shown in the front view of FIG. 6 and the plan view of FIG. 7, the guide nose half members 21 consist of members of the same shape which result when the guide nose 20 is divided into two halves.

Grooves 23, 24, 25 and 26 are formed, in order from the top to the bottom, on the inner surface of each of the half members 21. The grooves 23, 24 and 26 are generally rectangular in cross section, as is best seen from FIG. 5 and FIG. 9.

A pin 27 and a hole 28 are formed on the inner surface of each of the half members 21 so that when the two half members 21 are placed in confrontation, the pins 27 of the respective half members 21 are in alignment with the holes 28 of the opposite half members 21. When the two half members 21 are made to confront and the pin 27 of each half member 21 is pressure-inserted into the confronting hole 28 of the other half member 21, the unitary guide nose 20 is formed.

A recess 22 is formed on each of the outer surfaces of the half members 21. When the guide nose half members 21 are assembled the recesses 22 of the half members 21 are substantially parallel with each other. At the time of mounting, the nose guide 20 is fastened to a carriage 8 by sliding the guide nose 20 into a mounting groove 81 of the carriage 8 (FIG. 10 to FIG. 12) to such that the carriage engages in the recesses 22. The half members 21 are thereby securely fixed together.

The print wires 3 fit in a tip wire guide 51, an intermediate wire guide 52 and a bottom wire guide 53, and an oil felt 54. The wire guides, 51, 52 and 53 slidably support the print wires 3. The oil felt 54 contains impregnated oil to provide smooth sliding. The print wires 3 are fixed to the tips of the armatures 94 to form a spring assembly 181 (comprising annular spacer 204 plate spring 93, armature yoke 205, armatures 94 and print wires 3). The spring assembly 181 is clamped by the half members 21 in such a manner that the wire guides 51, 52 and 53, and the oil felt 54 fit in the grooves 23, 24, 26 and 25, respectively. Thus, the spring assembly 181 is integrally assembled in the pair of guide nose halves 21 to form the guide frame 2.

Figure 2:
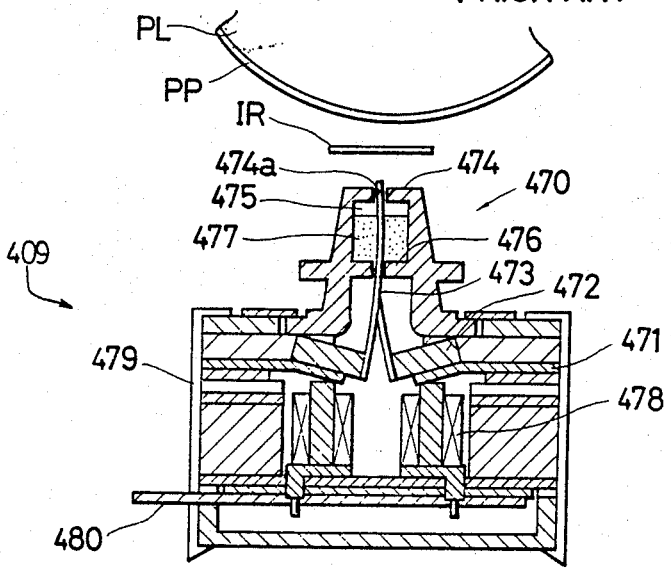
FIG. 2 PRIOR ART
FIG. 2 is a sectional view showing a conventional print head.
Figure 3:
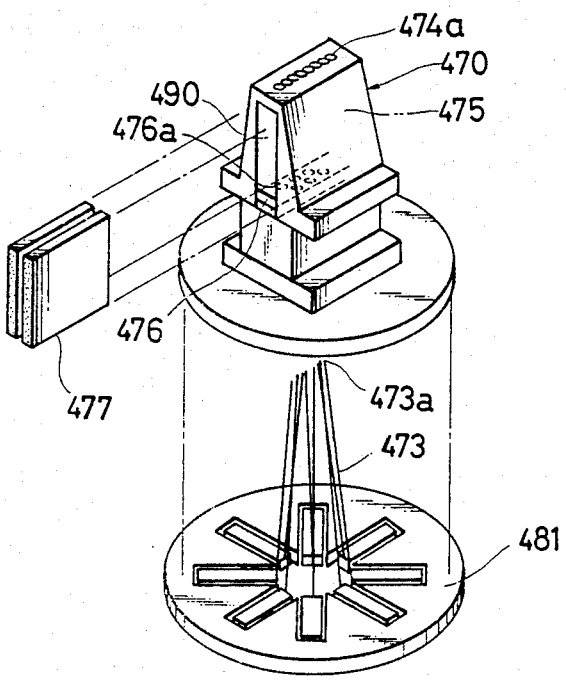
FIG. 3 PRIOR ART
FIG. 3 is an oblique view showing how the print head of FIG. 2 is assembled.
Figure 4:
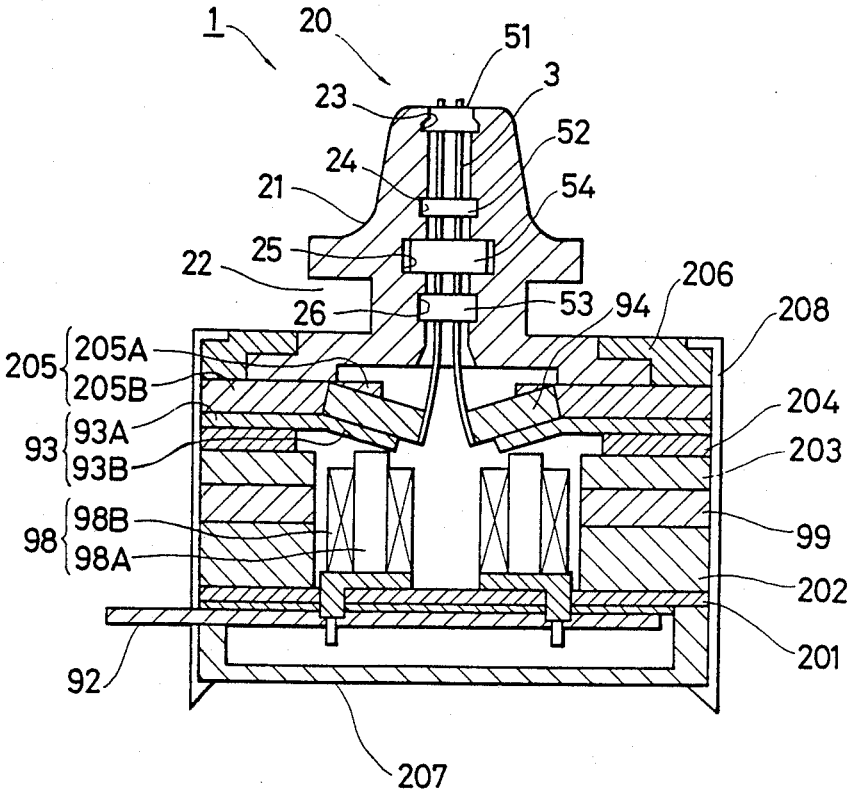
FIG. 4 is a sectional view showing a guide nose of a dot print head according to the invention.
Figure 5:
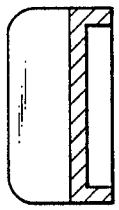
FIG. 5 is a cross sectional view of a half member of the guide nose.
Figure 6:
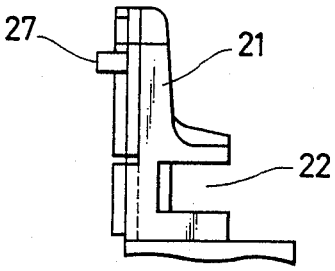
FIG. 6 is a front view of a half member.
Figure 7:
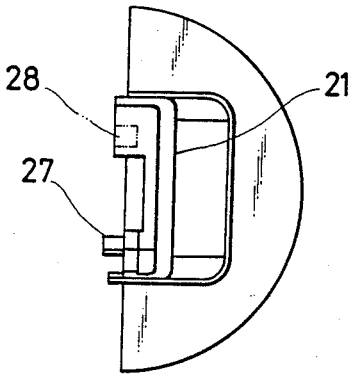
FIG. 7 is a plan view of the half member.
Figure 8:
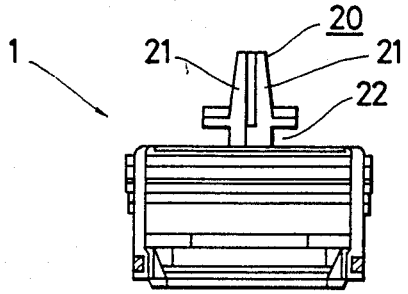
FIG. 8 is a schematic sectional view of the dot print head according to the invention.

A wire drive part which is similar to that shown in and described with reference to FIG. 1 to FIG. 3 is assembled with the guide nose 20. More specifically, lower (as seen in FIG. 4) ends of the wires 3 are fixed to respective armatures 94 supported by inwardly projecting parts 93B of a plate spring 93. The lower surfaces of the armatures 94 are in confrontation with upper ends of cores 98A on which coils 98B are wound to form electromagnets 98 for the respective wires 3. The lower ends of the cores 98A are fixed to a disk-shaped base plate 201 which is formed of a magnetically permeable material. A lower annular yoke 202, an annular permanent magnet 99, an upper annular yoke 203, an annular spacer 204, an annular part 93A of the plate spring 93, and an annular part 205B of an armature yoke 205 as well as a guide frame holder 206 and a peripheral part of the guide nose half members 21 form a cylindrical wall of the print head drive part. The coils 98B of the electromagnets 98 are electrically connected by a printed circuit board 92 to a drive circuit, not shown, for controlled selective energization in accordance with data for printing. The printed circuit board 92 is covered with a lower cover 207. The members forming the cylindrical wall of the print head drive part are clamped by a clamp member 208.

When the electromagnets 98 are not energized, the armatures 94 are attracted toward the cores 98A of the electromagnets 98 because of the magnetic flux from the permanent magnet 99. The projecting parts 93B of the plate spring 93 are thereby resiliently deformed. When the electromagnets 98 are energized, the magnetic flux due to the electromagnets 98 and the magnetic flux due to the permanent magnet 99 cancel each other and the print wires 93 are projecting from the guide holes in tip wire guide 51 by virtue of the resilient reactive force of the plate springs 93. As a result, the print wires 93 are pressed against an ink ribbon and a print paper on a platen (similar to the ink ribbon, print paper and platen shown in prior art FIGS. 1 and 2). Printing is thereby accomplished.

The assembly and the mounting of the print head of the above structure will now be described.

Figure 9:
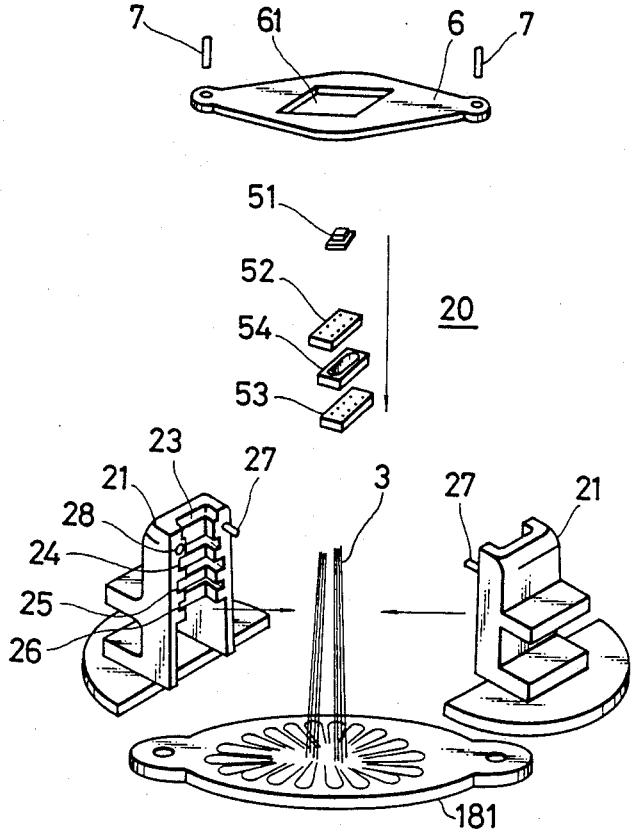
FIG. 9 is an exploded oblique view of the guide nose of the dot print head.

FIG. 9 is an exploded view of the guide nose 20 of the dot print head 1. At the time of assembly, a plurality of the print wires 3 which are generally parallel with each other are inserted through the bottom wire guide 53, then the oil felt 54, then the intermediate wire guide 52 positioned above the oil felt, and then the tip wire guide 51.

A pair of the half members 21 are disposed on both sides of the wire guides 51, 52 and 53 and the oil felt 54. The holes 28 are made to confront the pins 27 and the bottom wire guide 53, the oil felt 54, the intermediate wire guide 52 and the tip wire guide 51 are arranged for being fitted in the groove 26, the groove 25, the groove 24 and the groove 23, respectively. The pins 27 are then pressure-inserted into the confronting holes 28.

An opening 61 of a guide frame holder 6 is aligned with the guide nose 20 formed as described above, and knock pins 7, 7 are used for fixing the guide frame holder 6 to the spring assembly 181. The drive part is then assembled with the guide nose 20. This completes the dot print head 1.

Figure 10:
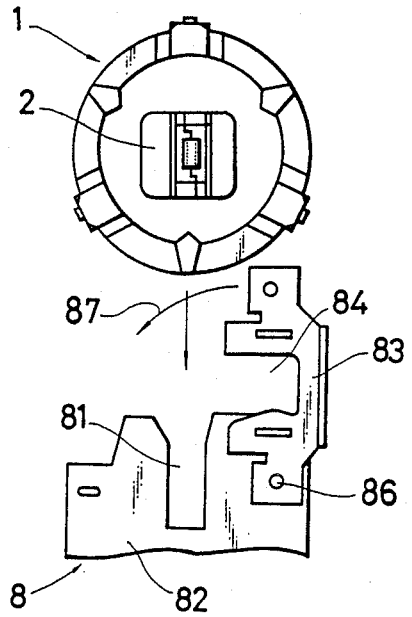
FIG. 10 is a diagram showing how the print head is mounted with a carriage.
Figure 11:
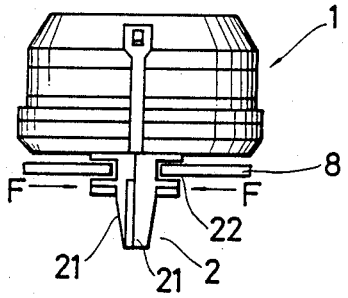
FIG. 11 is a diagram showing the print head mounted on the carriage.
Figure 12:
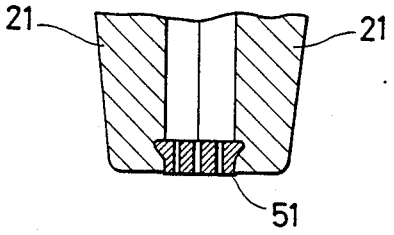
FIG. 12 is a partial view showing how the tip wire guide is clamped.
Figure 13:
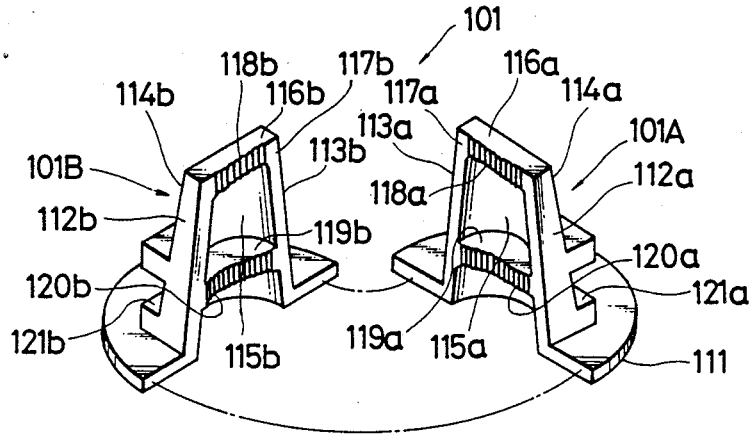

When the groove 23 within which the wire guide 51 is fit is tapered as shown in FIG. 4, the wire guide 51 is clamped by a so-called wedge effect. In particular, as shown in FIGS. 10 and 11, in order to fasten the nose guide 20 with the carriage 8, the guide nose 20 is slid into the mounting cutaway 81 of a first member 82 of the carriage 8, such that the carriage is received in the recesses 22 a second member 83 is then rotated as shown by arrow 87 about a pivot 86 such that guide nose 20 is received in a cutaway 84 of the second member 83 and the second member 83 is received within the recess 22 of the guide nose 20. Thus, the guide nose 20 is in engagement with the carriage 8, and a clamping force F is exerted from both sides of the half members 21 as shown in FIG. 11. Accordingly, the tip wire guide 51 is in a clamped condition, as shown in FIG. 12, such that is is free from vibration, detachment, etc. and does not require the use of an adhesive for fixing it within the guide nose 20.

As has been described, a dot print head according to the above embodiment comprises a pair of half members forming a guide nose, so that it is not necessary to insert an assembly of the print wires and the wire guide from below the guide nose. The is, the conventional insertion method is replaced by the clamping method, so that no air gap which results when the wire guides and the like are inserted in the guide frame is created.

As has been described, according to the dot print head of the above embodiment, the sliding parts of the print wires are completely sealed, and the tip wire guide can be securely supported. This considerably improves dust prevention and rust prevention such that the durability of the print wires is substantially extended. Moreover, the air gap AG is eliminated, so that the contact-slide noise due to the print wires and the wire guide is reduced. Furthermore, at the time of assembly of the dot print head, it is only necessary to clamp the spring assembly with the pair of half members. The assembly step is thereby extremely simplified.

FIGS. 13–17 show another embodiment of the invention. It comprises guide nose half members 101A and 101B forming a guide nose 101. The guide nose half member 101A and 101B from two halves of the guide nose 101 divided along a vertical plane. The half member 101A comprises upright side parts **112*a* and 113*a* extending vertically from a flange 111, and a rear plate 114*a* also extending upwardly from the flange 111 and bridging the side parts 112*a* and 113*a*. These three parts form a semi-annular recess 115*a*. Formed at the tip side of the semi-annular recess 115*a* is a tip guide part 116*a*. Formed on the abutting surface 117*a* of the upper guide part 116*a* are semi-annular grooves 118*a* of the same size as or slightly greater in size than the cross section of the print wires 173. Formed in the middle of the semi-annular recess 115*a* is an intermediate guide part 119*a*. Semi-annular grooves 120*a* similar to the above are also provided on the intermediate guide part 119*a*. In addition, a recess 121*a*** having a greater width than a clamp bar of a carriage is provided.

The half member 101B is similar to the half member 101A and includes side parts **112*b* and 113*b*, and a rear plate 114*b*, which together form a semi-annular recess 115*b*. A tip guide part 116*b* is formed at the tip side of the semi-annular recess 115*b* and semi-annular grooves 118*b* are formed on the abutting surface 117*b* of the tip guide part 116*b*. Moreover, an intermediate guide part 119*b*, corresponding to the intermediate guide part 119*a* of the half member 101A, is formed and semi-annular grooves 120*b* are formed corresponding to the semi-annular grooves 120*a*. The rear plate 114*b* is also provided with a recess 121*b* similar to the recess 121*a***.

Figure 14:
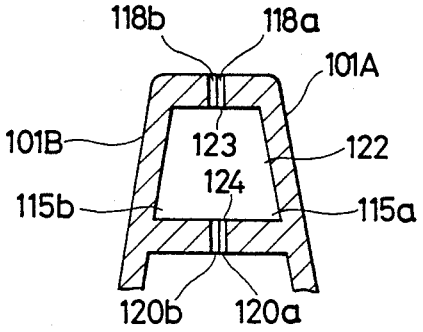
FIG. 14 is a partial cross sectional view of the guide nose shown in FIG. 13.

When the half members 101A and 101B are made to abut each other, the semi-annular receses **115*a* and 115*b* confront each other and form a sealed cavity 122 in the guide nose 101, as shown in the partial cross sectional view of FIG. 14. The guide felts are respectively fitted in advance in the semi-annular recesses 115*a* and 115*b*. The guide felts will therefore be present in the sealed cavity 122. The semi-annular grooves 118*a* and 118*b*, which in confrontation with each other, form guide holes 123 are formed. Similarly, the semi-annular grooves 120*a* and 120*b* of the intermediate guide parts form holes 124**.

Figure 15:
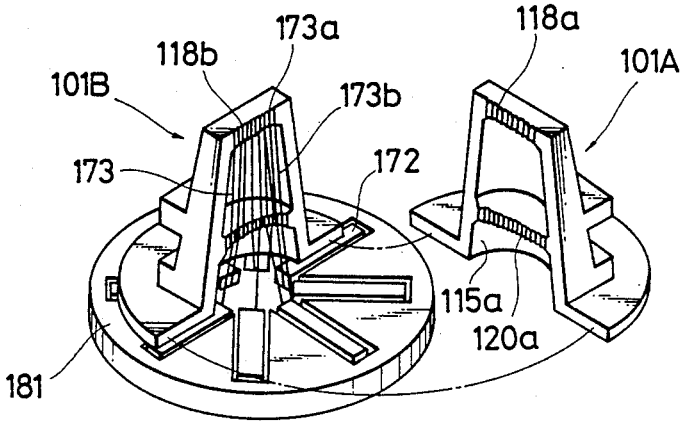
FIG. 15 is an oblique view showing a step of assembly of the guide nose shown in FIG. 13.

To assemble the print wires on the spring assembly 181 using the half members 101A and 101B, one of the half members, 101B, is brought into abutment with the print wires 173 fixed to the armatures 172, and the tips **173*a* of the print wires 173 are placed in the corresponding semi-annular grooves 118*b*, as shown in FIG. 15. Similarly, the trunk parts 173*b* of the print wires 173 are placed in the semi-annular grooves 120*b*. Next, the other half member, 101A, is brought from the lateral direction into abutment with the half member 101B. The semi-annular recesses 115*a* and 115*b* then form a sealed cavity 122, and the semi-annular grooves 118*a* and 118*b* form guide holes 123 in which the tip 173*a* of the print wires 173 are fit. At the same time, the semi-annular grooves 120*b* and 120*a* form holes 124 in which the trunk parts 173*b* of the print wires 173** are fit.

Figure 16:
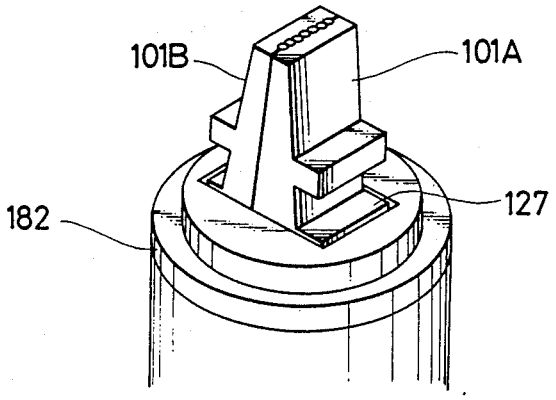
FIG. 16 is an oblique view of explaining how the guide nose and the drive part are mounted.
Figure 17:
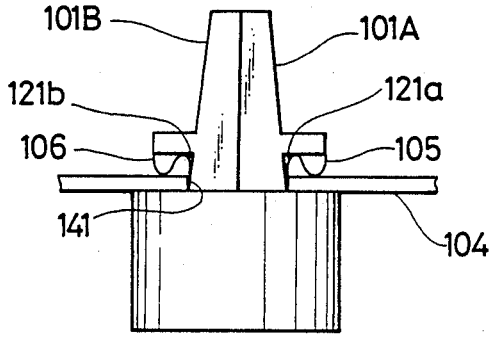
FIG. 17 is a side schematic view showing how the wire dot print head is mounted.

In this state, as shown in FIG. 16, mounting part 127 of the guide nose 101 is mounted onto an electromagnet assembly 182 (comprising upper annular yoke 203, permanent magnet 99, lower annular yoke 202, base plate 201 and electromagnet 98) such as shown in FIG. 4 so as to be integral with the drive part. Next, for mounting in a dot printer as shown in the schematic view of FIG. 17, the guide nose 101 is slid into a cutaway part 141 of a carriage 104 such that the carriage 104 engages in the recesses **121*a* and 121*b*. Clamp springs 105 and 106 are used for biasing the parts into a fixed position. Due to the mounting with the mounting part 127 and the spring bias of springs 105 and 106, the half members 101A and 101B** are maintained in an integrally assembled state.

Figure 18:
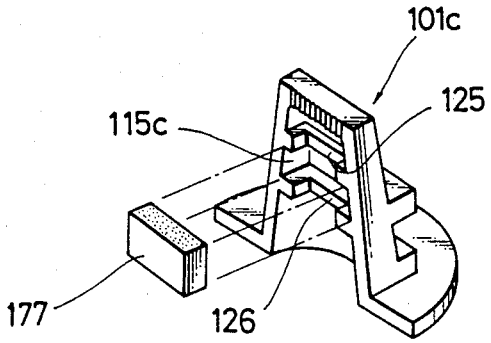
FIG. 18 is an oblique view showing a third embodiment of the guide nose half member.

FIG. 18 shows a half member 101C of another embodiment. In this half member 101C, a pair of supporting protrusions 125 and 126 are formed in the semi-annular recess **115*c* in place of the intermediate guide parts 119*a* and 119*b* of the above embodiment. Guide felts 177 are fitted between the supporting protrusions 125 and 126. It is therefore unnecessary to provide an opening for inserting the guide felts 177**. The sealed cavity can then be formed in the guide nose.

The above description relate to spring-charged dot print head. The invention is not limited to it but can be equally applied to the clapper type dot print head.

As has been described, according to the wire dot print head of the invention, insertion of the print wires in the guide nose, that is the assembly of the wire dot print head, can be simplified. The efficiency of production is thereby substantially improved. Moreover, the cavity in the guide nose can be formed in a sealed state. Therefore, noise of the print wires does not leak outside. The noise is thereby reduced.

What is claimed is:

1. A dot print head comprising:

a guide nose comprising first and second guide nose half members;

said first guide nose half member including means, comprising a first sidewall, for defining a first recess, and means, comprising a first tip guide part formed integrally with said first sidewall, for substantially closing a first end of said first recess, said first tip guide part having an abutting surface with grooves formed therein;

said second guide nose half member including means, comprising a second sidewall, for defining a second recess, and means, comprising a second tip guide part formed integrally with said second sidewall, for substantially closing a first end of said second recess, said second tip guide part having an abutting surface with grooves formed therein; and said first and second guide nose half members being detachably connectable along a dividing plane to form said guide nose, such that said first and second recesses together form a substantially sealed cavity, said abutting surface of said first tip guide part abuts with said abutting surface of said second tip guide part, and said grooves in said abutting surface of said first tip guide part align with said grooves in said abutting surface of said second tip guide part to form guide holes adapted to receive and slidably support print wires therethrough.

2. A dot print head as recited in claim 1, further comprising print wires extending through and slidably supported by said guide holes, said print wires extending substantially along a plane parallel with said dividing plane; and means for driving said print wires to selectively project from said guide holes to press an ink ribbon and print paper against a platen.

3. A dot print head as recited in claim 1, wherein said grooves in said abutting surface of said first tip guide part and said grooves in said abutting surface of said second tip guide part are semi-annular grooves which extend along said dividing plane when said first and second guide nose half members are connected along said dividing plane.

4. A dot print head as recited in claim 1, further comprising means, comprising a first intermediate wall, for substantially closing a second end of said first recess; and means, comprising a second intermediate wall, for substantially closing a second end of said second recess.

5. A dot print head as recited in claim 4, wherein said first intermediate wall is formed integrally with said first sidewall; and said second intermediate wall is formed integrally with said second sidewall.

6. A dot print head as recited in claim 4, wherein said first intermediate wall has an abutting surface with grooves formed therein; and said second intermediate wall has an abutting surface which abuts with said abutting surface of said first intermediate wall when said first and second guide nose half members are connected along said dividing plane, said abutting surface of said second intermediate wall having grooves formed therein which align respectively with said grooves formed in said abutting surface of said first intermediate wall, when said first and second guide nose half members are connected along said dividing plane, to form intermediate guide holes adapted to receive and slidably support print wires therethrough.

7. A dot print head as recited in claim 6, wherein said grooves, formed in each of said abutting surfaces of each of said first and second tip guide parts and said first and second intermediate walls, respectively, are semi-annular grooves which extend along said dividing plane when said first and second nose half members are connected along said dividing plane.

8. A dot print head as recited in claim 1, wherein said first sidewall has a first connecting surface with a first pin protruding therefrom; and said second sidewall has a second connecting surface with a first bore formed therein for receiving said first pin in a pressure-fit manner.

9. A dot print head as recited in claim 8, wherein said second connecting surface has a second pin protruding therefrom; and said first connecting surface has a second bore formed therein for receiving said second pin in a pressure-fit manner.

10. A dot print head as recited in claim 1, further comprising means for protecting and providing additional guidance for print wires extending through said guide holes;

said protecting means comprising at least one resilient member mounted in at least one of said first recess and said second recess.

11. A dot print head as recited in claim 10, wherein said at least one resilient member comprises at least one felt member.

12. A dot print head as recited in claim 1, wherein said first and second recesses comprise first and second semi-annular recesses, respectively.

13. A dot print head as recited in claim 1, further comprising first and second spaced apart support protrusions mounted within said first recess; and third and fourth spaced apart support protrusions mounted within said second recess.

14. A dot print head as recited in claim 13, wherein said first and second support protrusions are formed integrally with said first sidewall; and said third and fourth support protrusions are formed integrally with said second sidewall;

said first, second, third and fourth support protrusions being adapted to mount therebetween a guide felt member.

* * * * *